United States Patent [19]

Markert

[11] Patent Number: 5,014,973

[45] Date of Patent: May 14, 1991

[54] APPARATUS FOR GRIPPING AND DECOLLATING A BOTTOM BLANK OF A STACK OF BLANKS IN A BOOK COVERING MACHINE

[75] Inventor: Eberhard Markert, Rechberghausen, Fed. Rep. of Germany

[73] Assignee: Michael Hörauf Maschinenfabrik GmbH & Co. KG, Donzdorf, Fed. Rep. of Germany

[21] Appl. No.: 377,100

[22] Filed: Jul. 10, 1989

[30] Foreign Application Priority Data

Aug. 12, 1988 [DE] Fed. Rep. of Germany ..... 3827346
Apr. 26, 1989 [DE] Fed. Rep. of Germany ..... 3913656

[51] Int. Cl.[5] ..... B65H 3/10
[52] U.S. Cl. ..... 271/100; 271/165
[58] Field of Search ..... 271/165, 166, 99–102, 271/23, 94

[56] References Cited

U.S. PATENT DOCUMENTS

| | | | |
|---|---|---|---|
| 999,936 | 8/1911 | Wines | 271/101 |
| 3,655,181 | 4/1972 | Paulson | 271/165 X |
| 3,715,116 | 2/1973 | Salvade | 271/165 |
| 3,726,454 | 4/1973 | Robbins | 271/99 X |
| 3,908,983 | 9/1975 | Long | 271/165 |
| 4,494,745 | 1/1985 | Ward | 271/102 X |

*Primary Examiner*—Richard A. Schacher
*Attorney, Agent, or Firm*—Burns, Doane, Swecker & Mathis

[57] ABSTRACT

A book covering machine includes a mechanism for gripping and decollating the lower blank of a stack of blanks whose front portion is slightly bent relative to a rear portion thereof. The mechanism includes a support surface for the stack, the inclination of which surface can be adjusted relative to a front stop, whereby the angle between the support surface and the front stop can be made to correspond to the angle between rear and front portions of the stack.

9 Claims, 3 Drawing Sheets

APPARATUS FOR GRIPPING AND DECOLLATING A BOTTOM BLANK OF A STACK OF BLANKS IN A BOOK COVERING MACHINE

BACKGROUND AND OBJECTS OF THE INVENTION

The invention relates to an apparatus for gripping and decollating the bottom blank of a stack of blanks and is especially useful in a book covering machine.

Devices of this type are known (e.g., see a book covering machine BDM 20 of the Horauf Maschinenfabrik GmbH & Co. KG, Donzdorf, West Germany). In this known machine a supporting surface supports a stack of book cover blanks. The surface includes a recess which enables a suction grip to act on the bottom blank. A stop is oriented perpendicularly to the stop for abutting one end of the stack. The reason for orienting the stop perpendicularly to the supporting surface is that it has been assumed as a rule that the end of the stack is parallel to the plane of the supporting surface. This, however, is not true if, for example, the blanks are lacquered on their top side. In such a case the individual blanks, and therefore the entire stack, are bent so as to curve upward, so that the end of the stack is inclined relative to the stop, as depicted in FIG. 3. The bottom blank can then no longer be gripped and decollated with the usual amount of vacuum of the suction grip.

It is, therefore, an object of the invention to eliminate this disadvantage and to provide an apparatus of the aforementioned type wherein even a bent stack of blanks may be safely gripped and decollated in the aforedescribed manner.

SUMMARY OF THE INVENTION

This object is attained in accordance with the present invention by providing a support surface for the stack which can be adjusted relative to the stop surface such that the angle formed between the support surface and the stop corresponds to the angle formed between the front and rear portions of the bottom blank. Accordingly, the stack of blanks is no longer abutting with only one edge against the stop, but with its entire front end surface. The invention is based on the discovery that safe gripping and decollating of the lower blank of the stack is always possible if the front end of the stack is located at right angles to the stop.

THE DRAWINGS

The objects and advantages of the invention will become apparent from the following detailed description of preferred embodiments thereof in connection with the accompanying drawings, in which like numerals designate like elements, and in which.

DETAILED DESCRIPTION OF PREFERRED EMBODIMENTS OF THE INVENTION

Figure 1:
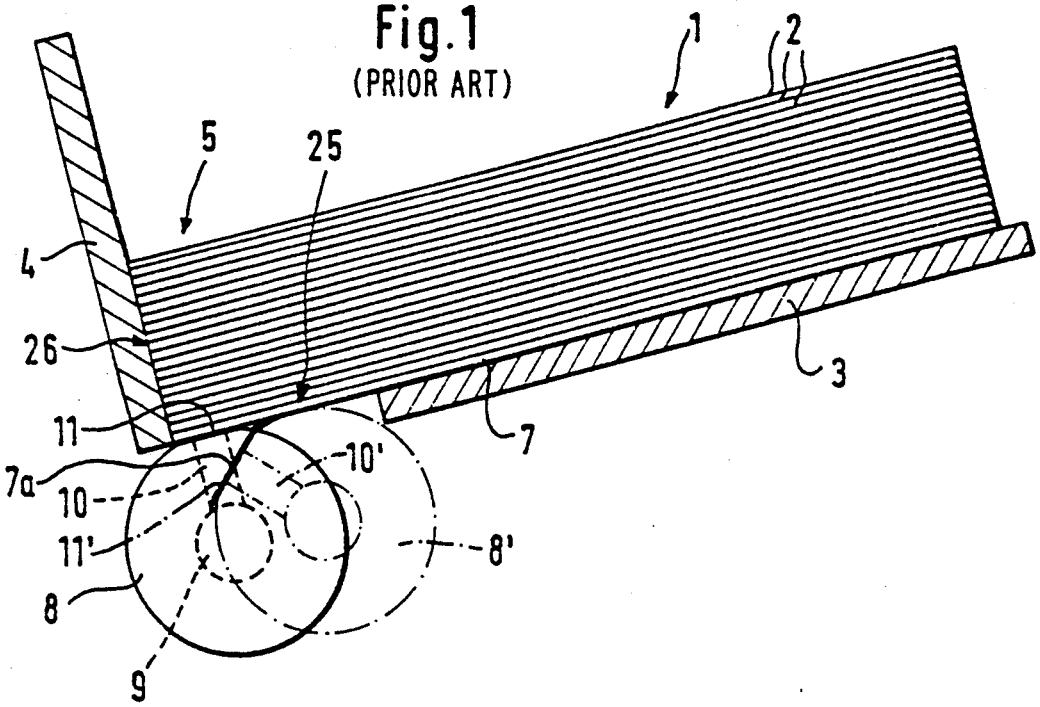
Fig. 1 (PRIOR ART)
FIG. 1 shows a conventional supporting device for a stack of blanks, together with its associated stop.
Figure 2:
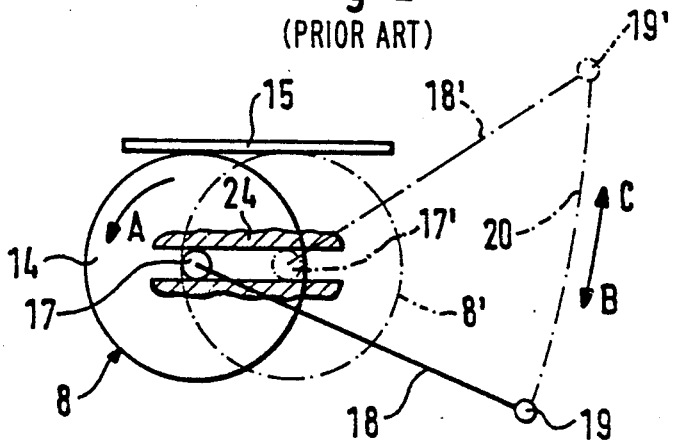
Fig. 2 (PRIOR ART)
FIG. 2 is a schematic view of the kinematics of the motion of the suction grip of the device of FIG. 1.
Figure 3:
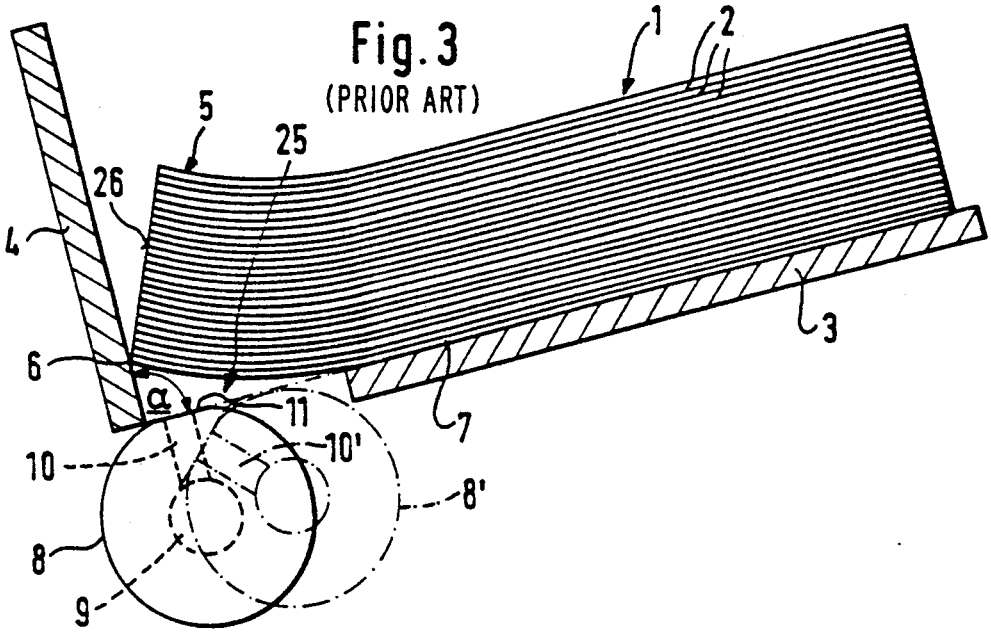
Fig. 3 (PRIOR ART)
FIG. 3 shows the supporting device according to FIG. 1, but with a stack of blanks bent upward at the front end.

A vertical stack 1 comprising a plurality of book cover blanks 2 is located on a conventional support plate 3, as depicted in FIGS. 1–3. In the case of blanks 2 which are not bent, i.e., are resting flat on the support plate, the front end 26 of the stack 1 is abutting flush against a front stop 4.

In the region of a suction grip 8 the support plate 3 has a recess 25. The suction grip comprises a shaft, which may be rotated and simultaneously displaced in a direction parallel to the support plate 3. The suction grip includes an internal suction channel 9, which extends across the width of the blanks 2 and is equipped with a plurality of suction orifices 10. The shaft of the suction grip 8 includes a flat 11 along its top in the form of a planar surface, against which the bottom blank 7 is resting when suctioned. When the suction grip 8 moves into the position 8' indicated by dash-and-dot lines, the suction orifice 10 assumes the position 10', so that the lower blank 7 is folded down with its frontal area from the stack 1, without yet being displaced relative to the stack in a direction parallel to the support plate 3. The bottom blank may then be drawn by another grip (not shown) from the stack and processed further.

The kinematics of the motion of the suction grip 8 are shown in FIG. 2. The shaft of the suction grip 8 is connected with a tooth gear 14, rolling on a rack 15 in the direction of the arrow A. By this rotating motion, the suction grip 8 is displaced into the position 8' indicated by a dash-and-dot line. Rotation against the arrow A returns the suction grip 8 into the position indicated in FIG. 1 by solid lines.

The axle 17 of the tooth gear 14 is supported in a bearing 24, with the axle 17 occupying the position 17' after the displacing motion. The rotating motion may be effected by means of a lever 18 one end of which is connected with the axle 17, and the other end 19 of which is moved by a drive such as a pivoting lever (not shown) along a guide (not shown in detail) into a position 19', whereupon the lever 18 occupies the position 18'. The end 19 of the lever 18 is thus moved in the direction of the arrows B and C.

FIG. 3 shows the device of FIG. 1 when processing a stack 1 of blanks 2 lacquered on their top side. Here, the stack 1 is bent slightly upward along its front portion 5 whereby only the bottom edge 6 of the stack front end 26 engages the stop 4. If, therefore, the support plate 3 forms an angle $\alpha$ of 90° with the stop 4, the bottom blank 7 cannot be effectively gripped and decollated by the suction grip 8, because the distance between the flat 11 and the bottom blank 7 is too great, and the stop 4 is in the way.

In order to have the front end of the stack 1 abut flush against the stop 4 to enable the bottom blank 7 to be gripped and removed from the stack 1, the present invention includes a device 27 in which a support 31 is situated between the bottom plate 3 and the stack 1. The support 31 forms with the stop 4 an acute angle $\beta$, so that the rear portion of the stack 1 also forms such angle $\beta$ with the stop 4, whereby the front bent portion 5 of the stack 1 is extending perpendicularly to the stop 4.

Within the recess 25 the suction grip 8 is arranged in a manner similar to that of FIG. 1. The flat 11 of the suction grip 4 is resting flush against the bottom blank according to the invention. The front end of the bottom blank can therefore be safely bent downward from the stack, in spite of the upwardly bent portion 5.

The device 27 comprises a bottom sheet 28 fastened by means of a holder 29 to the bottom plate 3. The support 31 is a component of a profile 30 U-shaped in cross-section, which in the area of the recess 25 is equipped with a spring plate 32. In this manner the support 31 may be adapted even better to the bottom blank along the front portion 5 of the stack 1 and is able to yield upon the return motion of the suction grip 8 into the position 8' (FIG. 2).

The side of the device 27 facing away from the stop 4 is provided with lateral brackets 33 comprising a generally vertical slot 34 for the manual setting of the selected angle $\beta$ of the profile 30. For this purpose, the profile 30 is secured at the desired angle by means of a screw 35. The slot 34 is curved about a center located at the intersection of the plane of the profile 30 and the plane of the bottom plate 3.

Since according to the invention, the stack front end 26 is resting flush against the stop 4, the bottom blank 7 can be readily gripped and removed by the suction grip 8.

Figure 5:
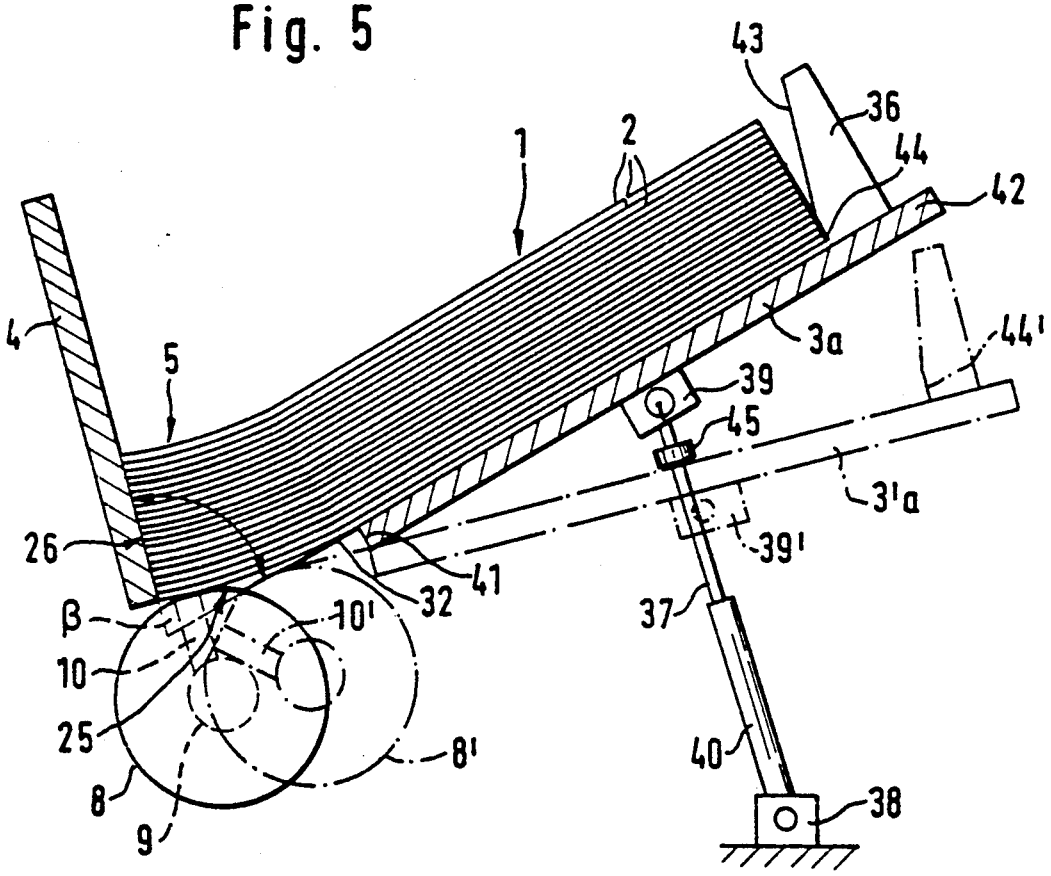
FIG. 5 shows a supporting device according to a second embodiment of the invention, wherein the bottom plate itself is adjustable relative to the stop.

FIG. 5 shows another embodiment according to the invention. In place of the previously disclosed solid bottom plate 3 aligned approximately at right angles relative to the stop 4, there is now provided in FIG. 5 a bottom plate 3*a* that may be adjusted to a suitable angle relative to the stop 4. The front edge 41 of the bottom plate 3*a* borders along the recess 25, and its rear edge 42 extends past the rear end of the stack. A stop 36 projects upwardly from the bottom plate 3*a* adjacent the rear end 42 thereof. The stop 36 is equipped with a stop surface comprised of an upper section 43 extending obliquely relative to both the bottom plate 3*a* and the rear end of the stack, and a lower section 44 located approximately perpendicularly to the surface of the bottom plate 3*a* in the region of the bottom blank 2 of the stack 1. The stop 36 is displaceable toward and away from the stack and assures that at least the lowest blanks of the stack 1 have their rear edges abutting against the lower section 44, whereby their front portions are positioned over the recess 25.

Figure 4:
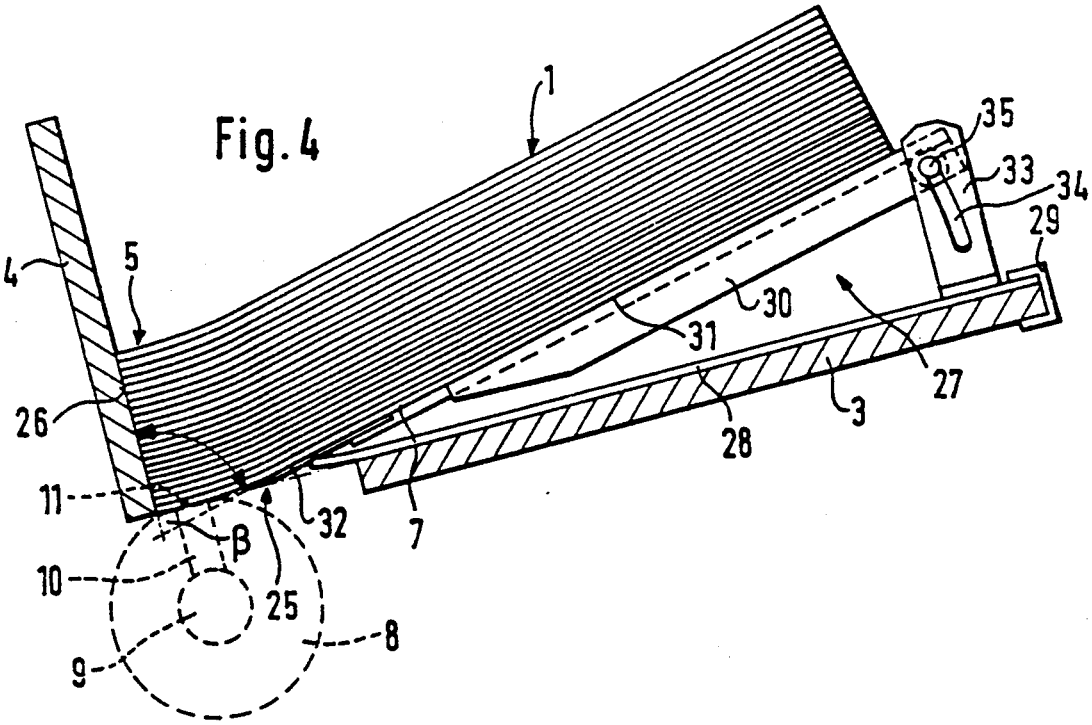
FIG. 4 depicts a supporting device according to a first preferred embodiment of the invention in which the suction grip corresponds to that of FIG. 1 and wherein a bottom plate with an adjustable support is provided.

The bottom plate 3*a* is provided with a holding device 39 to bearingly support a threaded spindle 37 cooperating with a threaded sleeve 40, which in turn, is pivotably mounted on a stationary holder 38. The threaded spindle 37 is rotatably mounted to the holder 39, preferably so that the spindle 37 can be rotated about its own axis relative to the sleeve 40 by means of a manual wheel 45 affixed to the spindle 37, in order to adjust the spindle 37. This makes it possible to move the bottom plate 3*a* from the position 3'*a* indicated by a dash-and-dot line into the position indicated by a solid line, in which its surface, as mentioned above, occupies the angle $\beta$ relative to the stop 4. The bottom plate 3*a*, in a manner similar to the support 31 in the embodiment of FIG. 4, may be equipped at its front edge 41 with a spring elastic plate 32, which provides a particularly advantageous abutting of the lowest blank and its ready removal of the lowest blank by the suction grip.

Although the present invention has been described in connection with preferred embodiments thereof, it will be appreciated by those skilled in the art that additions, substitutions, modifications, and deletions not specifically described may be made without departing from the spirit and scope of the invention as defined in the appended claims.

What is claimed is:

1. Apparatus for gripping and decollating a bottom blank of a vertical stack of blanks, said apparatus comprising:

support means including a support surface upon which the stack is supported with the bottom blank thereof engaging said support surface, a front portion of said support surface including a recess, suction gripping means arranged to grip the bottom blank through said recess, an upright stop disposed forwardly of said recess and extending transversely of said support surface for engaging a front end of the stack, adjusting means for adjusting the inclination of said support means and its support surface relative to said upright stop to vary the size of an angle defined between said support surface and said stop to compensate for stacks in which a stack front portion is bent relative to a stack rear portion, and a flexible plate carried at a forward end of said support surface and projecting forwardly therebeyond to overlie a portion of said recess and underlie a portion of the bottom blank of the stack.

2. Apparatus according to claim 1 wherein said support means comprises a bottom plate upon which a support member is mounted in such manner that the inclination thereof can be adjusted relative to said bottom plate, said support member forming said support surface.

3. Apparatus according to claim 2 wherein said adjusting means includes upstanding bracket means mounted on said bottom plate, a rear end of said support member being vertically adjustably connected to said bracket means.

4. Apparatus according to claim 3, wherein said bracket means comprises a pair of brackets each having a generally vertical slot formed therein, said support member carrying threaded bolts adjustably received in said slots.

5. Apparatus according to claim 4, wherein each of said slots is curved about a center located approximately at the intersection of a plane of said support surface and a plane of said bottom plate.

6. Apparatus according to claim 1, wherein said support surface comprises a surface on an adjustable bottom plate.

7. Apparatus according to claim 6, wherein a front edge of said bottom plate defines a rear edge of said recess, and said adjusting means is operably connected to said bottom plate for changing the inclination thereof.

8. Apparatus according to claim 7, wherein said adjusting means comprises a threaded spindle one end of which is mounted in a threaded sleeve and another end of which is pivotably connected to said bottom plate.

9. Apparatus according to claim 6, wherein a rear portion of said bottom plate carries an upstanding auxiliary stop arranged to bear against at least the bottom blank of the stack.

* * * * *